US011070918B2

(12) United States Patent
Kaplan

(10) Patent No.: US 11,070,918 B2
(45) Date of Patent: Jul. 20, 2021

(54) SOUND BAR WITH IMPROVED SOUND DISTRIBUTION

(71) Applicant: SSV WORKS, INC., Oxnard, CA (US)

(72) Inventor: Trevor Kaplan, Oxnard, CA (US)

(73) Assignee: SSV WORKS, INC., Oxnard, CA (US)

( * ) Notice: Subject to any disclaimer, the term of this patent is extended or adjusted under 35 U.S.C. 154(b) by 0 days.

(21) Appl. No.: 15/620,676

(22) Filed: Jun. 12, 2017

(65) Prior Publication Data

US 2017/0359654 A1 Dec. 14, 2017

Related U.S. Application Data

(60) Provisional application No. 62/348,755, filed on Jun. 10, 2016.

(51) Int. Cl.

| | |
|---|---|
| ***H04R 5/02*** | (2006.01) |
| ***H04R 1/02*** | (2006.01) |
| ***H04R 1/20*** | (2006.01) |
| *H04R 1/28* | (2006.01) |
| *H04R 1/24* | (2006.01) |

(52) U.S. Cl.

CPC ..... *H04R 5/02* (2013.01); *H04R 1/026* (2013.01); *H04R 1/20* (2013.01); *H04R 1/02* (2013.01); *H04R 1/24* (2013.01); *H04R 1/28* (2013.01); *H04R 1/2811* (2013.01); *H04R 2201/403* (2013.01); *H04R 2203/12* (2013.01); *H04R 2205/024* (2013.01); *H04R 2499/13* (2013.01)

(58) Field of Classification Search

CPC . H04R 5/02; H04R 1/026; H04R 1/20; H04R 2201/403; H04R 1/02; H04R 1/28; H04R 1/2811; H04R 1/2807; H04R 1/24; H04R 1/34; H04R 2203/12; H04R 2499/13; H04R 2205/024

See application file for complete search history.

(56) References Cited

U.S. PATENT DOCUMENTS

| | | | | |
|---|---|---|---|---|
| 8,675,899 | B2 * | 3/2014 | Jung | H04R 1/403 381/152 |
| 9,469,254 | B1 * | 10/2016 | White | B60R 11/0217 |
| 9,762,999 | B1 * | 9/2017 | Johnson | H04R 1/403 |
| 10,779,083 | B2 * | 9/2020 | Stead | H04R 5/02 |
| 2004/0223620 | A1 * | 11/2004 | Horbach | H04R 29/002 381/59 |
| 2005/0045777 | A1 * | 3/2005 | Lee | H04R 1/025 248/121 |
| 2005/0201583 | A1 * | 9/2005 | Colich | H04R 1/403 381/335 |

(Continued)

OTHER PUBLICATIONS

Wikimedia, Triaxial Ellipsoid, (Year: 2012).*

*Primary Examiner* — Duc Nguyen
*Assistant Examiner* — Kuassi A Ganmavo
(74) *Attorney, Agent, or Firm* — Ferguson Case Orr Paterson

(57) ABSTRACT

Sound bars with improved sound distribution are disclosed having at least first and second speaker drivers. The sound bars can have a spatial deviation point between the at least first and second speaker drivers such that the first and second speaker drivers are facing different directions. A second spatial deviation point can also be included to create additional directions for the driver speakers to face. The sound bars can include both active and passive speaker drivers.

14 Claims, 3 Drawing Sheets

(56) References Cited

U.S. PATENT DOCUMENTS

| | | | | |
|---|---|---|---|---|
| 2006/0153407 | A1* | 7/2006 | Keele, Jr. | H04R 1/403<br>381/182 |
| 2007/0269071 | A1* | 11/2007 | Hooley | H04R 1/403<br>381/336 |
| 2008/0212805 | A1* | 9/2008 | Fincham | H03G 3/004<br>381/160 |
| 2011/0019844 | A1* | 1/2011 | Chang | H04R 1/345<br>381/160 |
| 2012/0263324 | A1* | 10/2012 | Joyce | H04R 3/12<br>381/120 |
| 2014/0126753 | A1* | 5/2014 | Takumai | H04S 7/305<br>381/303 |
| 2018/0242077 | A1* | 8/2018 | Smithers | H04R 1/30 |

* cited by examiner

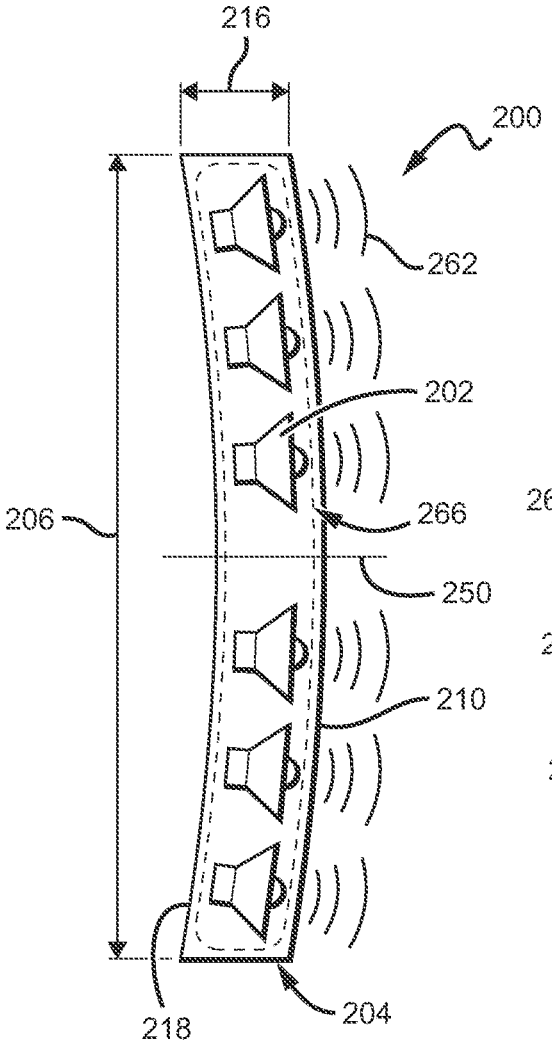
FIG. 2A
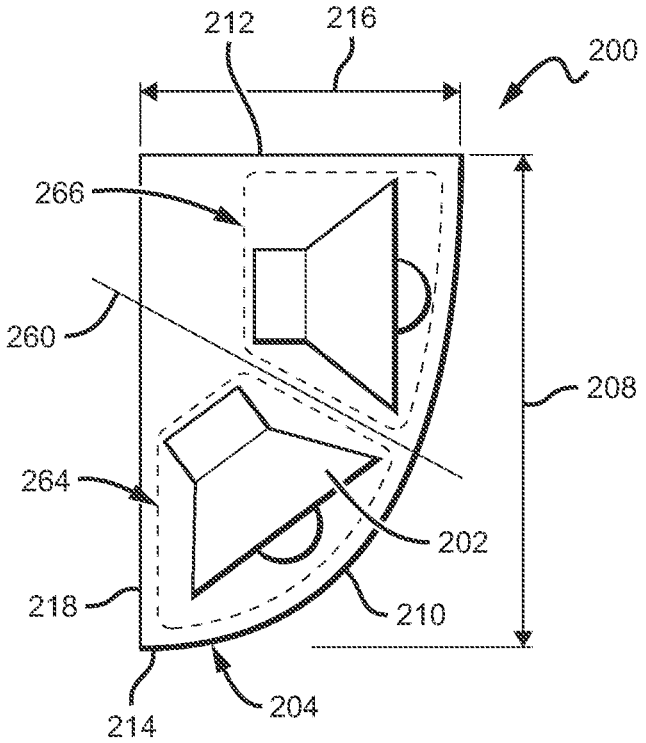
FIG. 2C
FIG. 2B
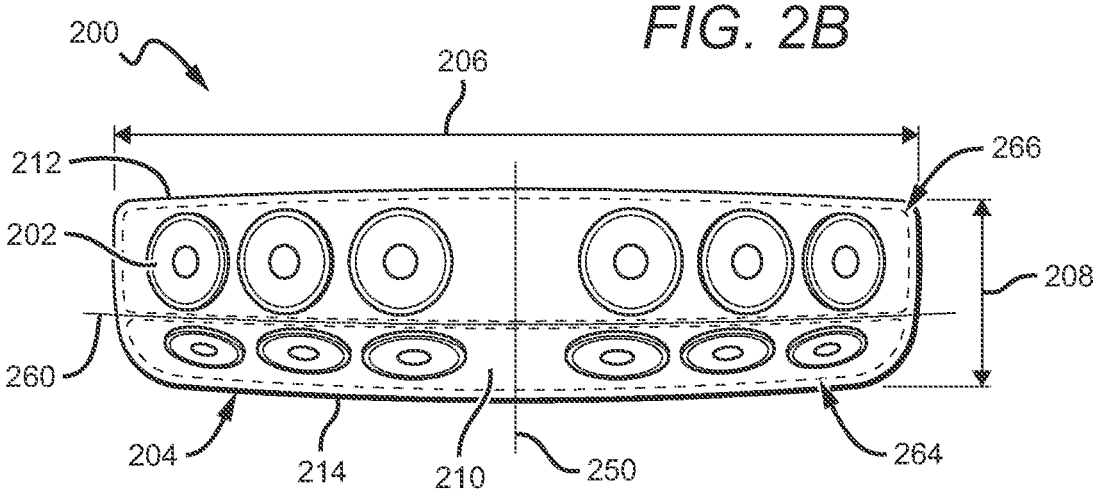

SOUND BAR WITH IMPROVED SOUND DISTRIBUTION

CROSS REFERENCE TO RELATED APPLICATIONS

This application claims the benefit of U.S. Provisional Application Ser. No. 62/348,755 to Trevor Kaplan, entitled SOUND BAR WITH IMPROVED SOUND DISTRIBUTION, filed on Jun. 10, 2016, which is hereby incorporated herein in its entirety by reference.

BACKGROUND

Field of the Invention

This present disclosure relates generally to audio devices and systems, and specifically to audio devices and systems incorporating sound bars for use in vehicles.

Description of the Related Art

In modern times, improvement in sound quality and performance is a common goal in the innovation of new audio devices and systems. One environment where this is particularly true is in the field of vehicle sound systems, for example, for use in off-road vehicles such as side-by-side vehicles and all-terrain vehicles. In these smaller off-road vehicles, which are constantly experiencing rougher conditions due to terrain during typical operation (in contrast to the average street-vehicle), it can be particularly difficult to achieve optimal sound distribution, for example, allowing all passengers within a passenger-compartment to listen to high quality and experience evenly distributed music.

The typical spatial arrangement of the passenger-compartment of vehicles, particularly smaller off-road vehicles, can create complications in optimizing quality sound system output. For example, conventional linear sound bars, typically installed in these vehicles, only provide linear audio. In the non-linear environment of an off-road vehicle passenger-compartment, this can result in sub-optimal sound distribution. For example, certain portions of the passenger-compartment of the vehicle can experience "hot spots," or areas of concentrated sound, where sound can seem louder. Conversely, other portions of the internal passenger-compartment of the vehicle can experience areas of softer sound, resulting in an uneven sound distribution throughout the passenger-compartment of the vehicle.

SUMMARY

Described herein are sound bar devices incorporating features to improve sound distribution. These sound bar devices are particularly useful for use in vehicles, for example, all-terrain vehicles. These improved features can include various configurations, for example, curved body portions and use of additional speakers and body emission faces configured to emit sound in various directions.

In one embodiment, a sound bar device comprises a sound bar body comprising a sound bar body length and a sound bar body width, and at least two speaker drivers at least partially in the sound bar body. The at least two speaker drivers comprise a first speaker driver configured to emit sound in a first direction, and a second speaker driver configured to emit sound in a second direction.

In another embodiment, a sound bar device comprises a sound bar body and at least two speaker drivers at least partially in the sound bar body, with the at least two speaker drivers comprising at least a first speaker driver and a second speaker driver. The sound bar body comprises at least one spatial deviation point, with a curved surface on either side of the least one spatial deviation point. The first speaker driver is on one side of the spatial deviation point and the second speaker driver is on a second side of the spatial deviation point opposite the first side of said spatial deviation point.

In yet another embodiment, a sound bar device comprises a sound bar body comprising a plurality of faces, which comprise at least a first emission face and a second emission face, the second emission face separated from the first emission face by an edge of said sound bar body. The sound bar body further comprises at least two speaker drivers at least partially in the sound bar body, the at least two speaker drivers comprising a first speaker driver at least partially in the first emission face and configured to emit sound in a first direction, and a second speaker driver at least partially in the second emission face configured to emit sound in a second direction.

These and other further features and advantages of the invention would be apparent to those skilled in the art from the following detailed description, taken together with the accompanying drawings, wherein like numerals designate corresponding parts in the figures, in which:

BRIEF DESCRIPTION OF THE DRAWINGS

FIG. 2A is a schematic representation of a top view of an embodiment of a sound bar device incorporating features of the present invention;

FIG. 2B is a schematic representation of a front view of the embodiment of a sound bar device of FIG. 2A;

FIG. 2C is a schematic representation of a partial sectional side angle view of the embodiment of a sound bar device of FIG. 2A.

DETAILED DESCRIPTION

Figure 1A:
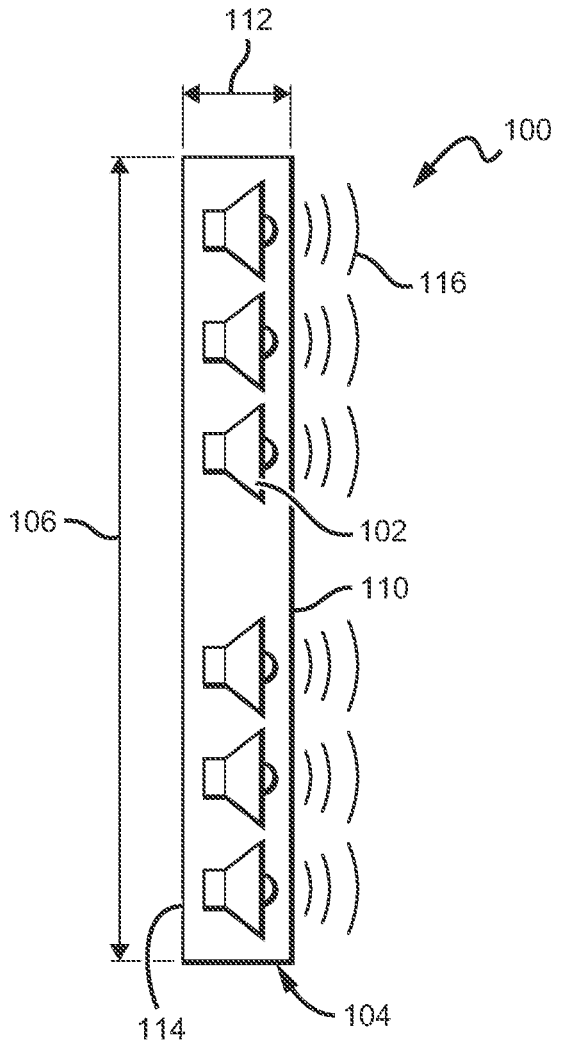
FIG. 1A CONVENTIONAL ART
FIG. 1A is a schematic representation of a top view of a conventional sound bar device.

In the following detailed description, numerous specific details are set forth in order to provide a more thorough understanding of embodiments incorporating features of the present invention. However, it will be apparent to one skilled in the art that the present invention can be practiced without necessarily being limited to these specifically recited details. Described herein are sound bar devices incorporating features to improve sound distribution. These sound bar devices are particularly useful for use in vehicles, for example, all-terrain vehicles. These improved features can include various configurations, for example, curved body portions and use of additional speakers and body emission faces configured to emit sound in various directions, which will become apparent as specific embodiments are described.

All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Throughout this description, the preferred embodiment and examples illustrated should be considered as exemplars, rather than as limitations on the present invention. As used herein, the term "invention," "device," "present invention," or "present device" refers to any one of the embodiments of the invention described herein, and any equivalents. Furthermore, reference to various feature(s) of the "invention," "device," "present invention," or "present device" throughout this document does not mean that all claimed embodiments or methods must include the referenced feature(s).

Furthermore, any element in a claim that does not explicitly state "means for" performing a specified function, or "step for" performing a specific function, is not to be interpreted as a "means" or "step" clause as specified in 35 U.S.C. § 112, for example, in 35 U.S.C. § 112(f) or pre-AIA 35 U.S.C. § 112, sixth paragraph.

It is also understood that when an element or feature is referred to as being "on" or "adjacent" to another element or feature, it can be directly on or adjacent the other element or feature or intervening elements or features may also be present. It is also understood that when an element is referred to as being "attached," "connected" or "coupled" to another element, it can be directly attached, connected or coupled to the other element or intervening elements may be present. In contrast, when an element is referred to as being "directly attached," "directly connected" or "directly coupled" to another element, there are no intervening elements present. For example, if an upper support component is said to be connected to a lower support component, which in turn is said to be connected to a base component, it is also correct to say that the upper support component is connected to the base component (through the intervening connection of the lower support component). Furthermore, the upper support component in the previous example would not be "directly" connected to the base component, but would be "directly" connected to the lower support component.

Please note, if used, relative terms such as "left," "right," "front," "back," "top," "bottom," "forward," "reverse," "clockwise," "counter clockwise" "outer," "above," "upper," "lower," "below," "horizontal," "vertical" and similar terms, have been used for convenience purposes only and are not intended to imply any particular fixed direction. Instead, they are used to reflect relative locations and/or directions between various portions of an object.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein, but are to include deviations in shapes that result, for example, from manufacturing.

It is understood that when a first element is referred to as being "between," "sandwiched," or "sandwiched between" two or more other elements, the first element can be directly between the two or more other elements or intervening elements may also be present between the two or more other elements. For example, if a first element is "between" or "sandwiched between" a second and third element, the first element can be directly between the second and third elements with no intervening elements or the first element can be adjacent to one or more additional elements with the first element and these additional elements all between the second and third elements.

Before discussing specific embodiments incorporating features of the present invention, for comparative purposes, contrasting configurations of conventional sound bar devices are described with reference to FIGS. 1A-1C, which show a conventional sound bar device 100, comprising a plurality of speaker drivers 102, housed within a sound bar body 104. The conventional sound bar device 100 is linear and each of the speaker drivers 102 in the plurality of speaker drivers are all facing and/or otherwise configured to emit sound in a linear manner in the same single direction.

Figure 1C:
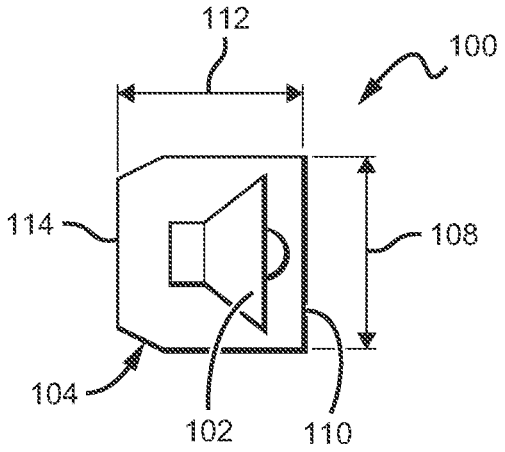
FIG. 1C CONVENTIONAL ART
FIG. 1C is a schematic representation of a partial sectional side angle view of the conventional sound bar device of FIG. 1A.
Figure 1B:
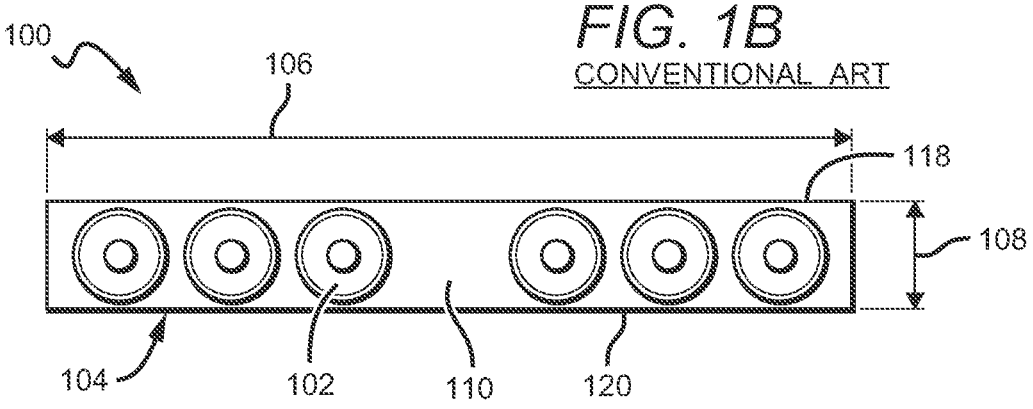
FIG. 1B CONVENTIONAL ART
FIG. 1B is a schematic representation of the front view of the conventional sound bar device of FIG. 1A.

The conventional sound bar device 100 described in reference to FIGS. 1A-1C is linear across both its length 106 and width 108. It is understood that the terms "length" and "width" as used herein in reference to both the conventional sound bar 100 shown in FIGS. 1A-1C, as well as sounds bars incorporating features of the present invention, are used in reference to the two-dimensional front face 110 of the sound bar body 102 being described. As the sound bar bodies 104 being described are in actuality three-dimensional objects, they also comprise a third dimension, which is described in the present application as "thickness." Accordingly, the thickness 112 of the sound bar body 102 shown in FIGS. 1A-1C describes the spatial dimension of the sound bar body 104 between the front face 110 and the back face 114, which is opposite the front face 110. The front face 110 is a sound emission face, as it is a face portion of the sound bar body 104 from which the speaker drivers 102 emit sound 116. The length 106 of the sound bar body 102 describes the spatial dimension comprising the entire length of the sound bar body 104 as shown in FIGS. 1A-1C, whereas the width 108 describes the spatial dimension of the sound bar body 104 spanning from the top portion 118 of the front face 110 of the sound bar device to the bottom portion 120 of the front face 110 of the sound bar device 100.

The conventional sound bar device 100 emits sound 116 from each of its associated speaker drivers 102 in substantially the same direction, that is, in a linear direction from a single emission face (the front face 110) of the sound bar body 104. This results in a non-uniform distribution of sound, especially in the context of the conventional sound bar 100 being installed into a portion of the passenger-compartment of a vehicle, such as an all-terrain vehicle. The sound 116 will emit linearly in substantially a single direction, which in the turbulent conditions of off-road travel, will result in passengers in different portions of the passenger-compartment of the vehicle experiencing different concentrations of emitted sound, with certain louder "hot spots" in certain regions of the passenger-compartment and softer areas of sound in other regions.

The above-described variations in sound can be eliminated or mitigated through employment of embodiments of sound bars incorporating features of the present invention. One example of such an embodiment of a sound bar 200 is set forth in FIGS. 2A-2C, which show that sound bar 200 comprising at least two speaker drivers 202 (a total of twelve shown in FIG. 2B; with six of the twelve being visible in the angle shown in FIG. 2A and two being visible in the angle shown in FIG. 2C), and a sound bar body 204.

While the actual spatial configuration of the embodiment of the sound bar 200 shown in FIGS. 2A-2C differs from that of the conventional sound bar 100 in FIGS. 1A-1C described above, the spatial dimensional terminology conventions used herein with regard to FIGS. 2A-2C is similar to that used to describe the configuration with regard to FIGS. 1A-1C and is therefore only discussed briefly herein. The sound bar body 104 in FIGS. 2A-2C comprises a sound bar length 206, which spans the entire length of the sound bar body 204 as best shown in FIGS. 2A and 2B. The sound bar body further comprises a sound bar width 208, which spans the width of a front emission face 210 of the sound bar body 204, from a top portion 212 of the front face 210 to a bottom portion 214 of the front face 210, as best shown in FIGS. 2B and 2C. The sound bar body 204 further comprises a sound bar thickness 216, which spans the dimension between the front face 210 of the sound bar body 204 to a back face 218 of the sound bar body 204, as best shown in FIGS. 2A and 2C. As mentioned above in regard to describing the spatial dimensions of the conventional sound bar 100 in FIGS. 1A-1C, the terms "length" and "width" are used in reference to the front face 210 of the sound bar body 204.

The sound bar body 204 of the sound bar device 200 can comprise any suitable material, with the preferred material being a sturdy material that can support and/or protect internal audio devices. The body 204 can comprise material that has favorable acoustic qualities and that does not prevent or negatively impact the quality of sound produced by an internal audio device. Some suitable materials the body 202 can comprise include, but are not limited to, resin, rubber, vinyl, polyurethane, poly vinyl chloride (PVC), Poly(methyl methacrylate) (PMMA), polystyrene foam, polymers/copolymer substances, acrylic substances, plastic, metal, glass, fiberglass, wood or a combination thereof.

The speaker drivers 202 can comprise any known speaker driver, including but not limited to, any transducer, woofer, sub-woofer, tweeter, or midrange driver, passive radiators, etc. The speaker drivers can be active (e.g. amplified) or passive (e.g. moving due to air pressure within the sound bar body 204). The speaker driver 202 can be at least partially in the sound bar body, and in some embodiments, are completely housed within the sound bar body.

One of the clearest noticeable differences between the embodiment of FIGS. 2A-2C and the conventional sound bar 100 in FIGS. 1A-1C is that the sound bar body 204 of the sound bar 200 of FIGS. 2A-2C comprises a different spatial configuration than the conventional sound bar 100 of FIGS. 1A-1C. Instead of being completely linear, the sound bar body 204 of FIGS. 2A-2C comprises curved surfaces along one or more of its dimensional axes. For example, embodiments incorporating feature of the present invention can comprise curved surfaces along their length 206, width 208 or thickness 216. In the specific embodiment shown in FIGS. 2A-2C, the sound bar body 204 comprises curved surfaces along its length 206 and width 208, although it is understood that in some embodiments, different portions of the sound bar body 204 can comprises curved surfaces, for example, in some embodiments only one of the length 206, width 208 or thickness 216 comprise curved surfaces and in some embodiments two of these listed dimensions or all three of them comprise curved surfaces.

By configuring the sound bar body 204 to comprise curved surfaces between adjacent speaker drivers 202 within the same sound bar, the speaker drivers can be displaced or offset from one another and be configured to emit sound in varying directions. For example, FIGS. 2A and 2B show a spatial deviation point 250 along the length 206 of the sound bar body 204. The spatial deviation point 250 is an area of the sound bar body 204, which comprises a curved surface on either side of it along the length 206 of the sound bar body 204 with different curvatures or centuries of curvature. In the embodiment shown, the spatial deviation point 250 comprises curved surfaces on either side of the spatial deviation point 250, as well as a set of adjacent speaker drivers 202 on either side of the spatial deviation point 250. In the embodiment shown, the portions of the sound bar body 202 on either side of the spatial deviation point 250 curve away from the front face 210 and curve toward the back face 218. This gives the front face 210 of the sound bar body 204 a "convex" appearance. It is understood that in some embodiments, the portions of the sound bar body 202 on either side of the spatial deviation point 250 can curve toward the front face 210 and curve away from the back face 218, giving the front face 210 of the sound bar body 204 a "convex" appearance.

The sound bar body 204 can comprise another spatial deviation point 260 along its width 208 (best shown in FIGS. 2B and 2C). Like with the spatial deviation point 250 described above with regard to the length 206 of the sound bar body 204, the spatial deviation point 260 is an area of the sound bar body 204, which comprises a curved surface on either side of it along the width 208 of the sound bar body 204. In the embodiment shown, the spatial deviation point 260 comprises curved surfaces on either side of the spatial deviation point 260 with different curvatures or centers of curvature, as well as a set of adjacent speaker drivers 202 on either side of spatial deviation point 260. In the embodiment shown, the portions of the sound bar body 202 on either side of the spatial deviation point 260 curve away from the front face 210 and curve toward the back face 218. This gives the front face 210 of the sound bar body 204 a "convex" appearance. It is understood that in some embodiments, the portions of the sound bar body 202 on either side of the spatial deviation point 260 can curve toward the front face 210 and curve away from the back face 218, giving the front face 210 of the sound bar body 204 a "convex" appearance.

By having the curved surfaces along the length 206 and width 208 of the sound bar body 204, the sound bar device 200 can emit sound in a manner that is not entirely linear. As shown in FIG. 2A, the curvature of the sound bar body 204 results in a more "spread out" distribution of sound 262 due to the spatial offset of the adjacent speaker drivers 202 within the same sound bar device, when contrasted with the linear sound distribution of the conventional sound bar device 100 of FIGS. 1A-1C. Another difference between the sound bar device 200 of FIGS. 2A-2C and the conventional sound bar device 100 of FIGS. 1A-1C is that the sound bar device 200 of FIGS. 2A-2C can comprises a second plurality of speakers 264 in addition to the first plurality 266, in order to further distribute sound over a wider variety of angles to improve sound emission uniformity. In the embodiment shown in FIGS. 2A-2C, the first plurality of speakers 266 emit sound in a first direction, for example, emitting sound in a direction substantially orthogonal to the speaker drivers 202 in the front face 210 of the sound bar body 204, with the variation that the sound is not emitted substantially linear due to the offset of the curved length 206 of the sound bar body 204.

The second plurality of speakers 264 can be configured to emit sound in a second direction, for example, a direction different that the direction the first plurality of speakers 266 emit sound. For example, in the embodiment shown in FIGS. 2A-2C, the second plurality of speakers 264 can be configured to emit sound at a downward angle, for example, emitting sound downward in the passenger compartment of a vehicle, which has the advantage of creating better sound quality distribution by reflecting the sound off the floor or dashboard of the passenger compartment of the vehicle in addition to emitting sound toward the passengers from the first plurality of speaker drivers 266. In some embodiments, some speaker drivers are active speaker drivers and some speaker drivers are passive speaker drivers. In some embodiments all speaker drivers are active speaker drivers. In the embodiment shown in FIGS. 2A-2C, the first plurality of speaker drivers 266 comprise active speaker drivers and the second plurality of speaker drivers 264 comprise passive speaker drivers.

It is understood that while two separate pluralities of speaker drivers are described above, embodiments of smaller sound bar devices incorporating features of the present invention can incorporate the principles herein to devices of only two speakers. For example, in some embodiments, the sound bar device 200 can comprise a single first speaker driver configured to emit sound in a first direction, for example, toward the passengers of a vehicle, and a single second speaker driver configured to emit sound in a second direction, for example, toward the dashboard or floor of a vehicle.

Figure 3:
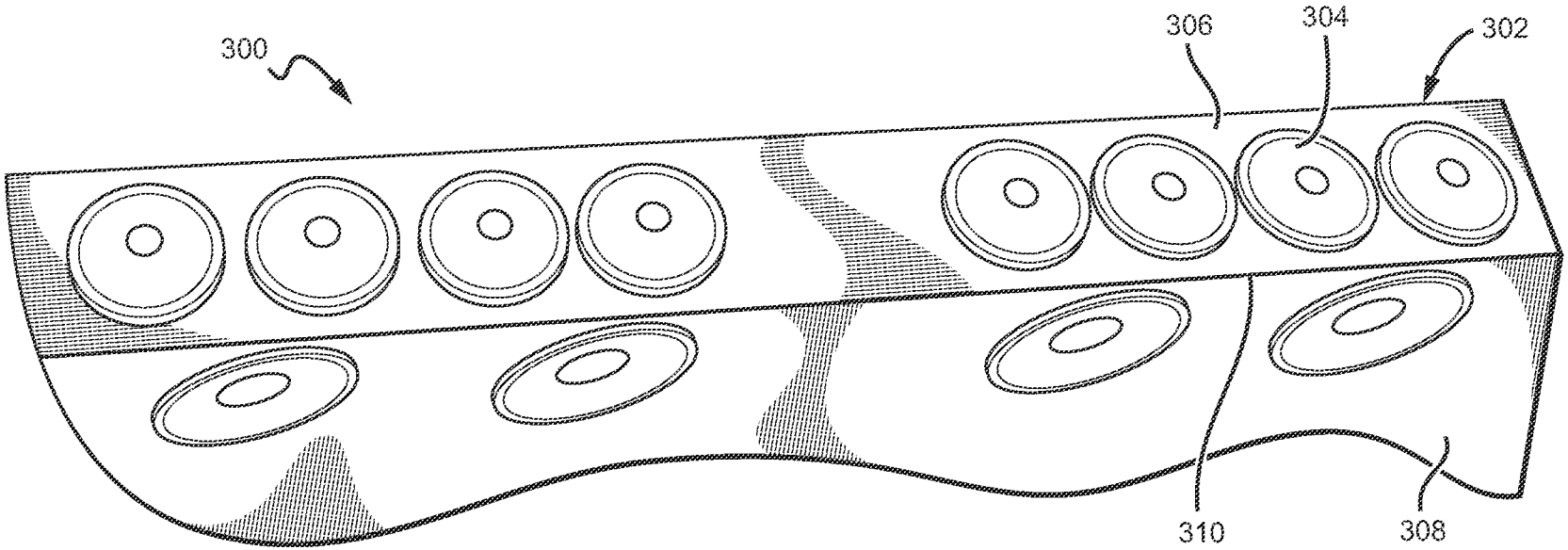
FIG. 3 is a front and lower perspective view of another embodiment of a sound bar device incorporating features of the present invention.

In addition to, or in lieu of, curved surfaces, sound bar devices incorporating features of the present invention can comprise multiple emission faces. FIG. 3 shows a sound bar device 300 comprising a sound bar body 302 and at least two speaker drivers 304 (twelve shown) and comprising multiple faces including a first sound emission face 306, comprising at least one speaker driver 304, and a second sound emission face 308, comprising at least one speaker driver 304. The second emission face 308 is separated by the first emission face 304 by at least one edge 310 of the sound bar body 302. In the embodiment shown, the speaker drivers in the first emission face 306 are configured to emit sound in a first direction, for example, roughly orthogonally from the first emission face 306, and the speaker drivers in the second emission face 308 are configured to emit sound in a second direction, for example, roughly orthogonally from the second emission face 308. In the embodiment shown, the speaker drivers in the first emission face 306 are active and the speaker drivers in the second emission face 308 are passive, although it is understood that different combinations of speaker drivers can be utilized.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in any claims.

I claim:

1. A sound bar device, comprising:

a sound bar body, said sound bar body comprising a sound bar body length and a sound bar body width, said sound bar body further comprising:

a front face intended to emit sound;

a vertical spatial deviation point on said front face dividing said front face into left and right portions;

a horizontal spatial deviation point dividing said front face into top and bottom portions; and wherein said vertical spatial deviation point and said horizontal spatial deviation point define four discrete curved subsurfaces on said front face, each of said subsurfaces facing in a different general direction; and at least four speaker drivers at least partially in said sound bar body with at least one of said speaker drivers in each of said four subsurfaces on said front face, said at least four speaker drivers comprising a first speaker driver in a first of said subsurfaces configured to emit sound in a first direction, a second speaker driver in a second of said subsurfaces configured to emit sound in a second direction, a third speaker driver in a third of said subsurfaces configured to emit sound in a third direction, and a fourth speaker driver in a fourth of said subsurfaces configured to emit sound in a fourth direction, said at least four speaker drivers on two or more curved surfaces of said sound bar such that said first, second, third, and fourth speaker drivers face different directions, wherein said left and right portions of said front face curve in a direction away from said vertical spatial deviation point, and said top and bottom portions of said front face curve in a direction away from said horizontal spatial deviation point such that said front face comprises a continuous surface.

2. The sound bar device of claim 1, wherein said sound bar body length comprises a curved surface.

3. The sound bar device of claim 2, wherein said sound bar body curves away from said front face of said sound bar body on either side of said vertical spatial deviation point, forming a convex surface.

4. The sound bar device of claim 2, wherein said sound bar body curves away from said front face of said sound bar body on either side of said horizontal spatial deviation point, forming a convex surface.

5. The sound bar device of claim 1, wherein said sound bar body comprises a curved surface along said width.

6. The sound bar device of claim 1, wherein said first speaker driver is in a first plurality of speaker drivers and said second speaker driver is in a second plurality of speaker drivers.

7. The sound bar device of claim 6, wherein said first plurality of speaker drivers comprises active speaker drivers and said second plurality of speaker drivers comprises passive speaker drivers.

8. The sound bar device of claim 7, wherein said first plurality of speaker drivers are configured to emit sound toward passenger areas in a vehicle and said second plurality of speaker drivers are configured to emit sound downward toward a floor of the vehicle.

9. A sound bar device, comprising:

a sound bar body configured to attach to a vehicle frame, said sound bar body comprising a length and a width;

a plurality of speaker drivers at least partially in said sound bar body;

wherein said sound bar body comprises at least two spatial deviation points, said at least two spatial deviation points comprising a horizontal spatial deviation point along the length of said sound bar body and a vertical spatial deviation point along the width of said sound bar body, said sound bar body comprising curved surfaces on either side of said horizontal spatial deviation point and on either side of said vertical spatial deviation point such that a front emission face of said sound bar body comprises four discrete curved subsurfaces that face in distinct general directions, wherein said curved surfaces on either side of said vertical spatial deviation point curve in a direction away from said vertical spatial deviation point, and said curved surfaces on either side of said horizontal spatial deviation point curve in a direction away from said horizontal spatial derivation point such that said sound bar body comprises a continuous surface.

10. The sound bar device of claim 9, wherein said sound bar body curves away from said front emission face of said sound bar body on either side of said vertical spatial deviation point, forming a convex surface.

11. The sound bar device of claim 9, wherein a first of said speaker drivers in a first of said subsurfaces is configured to emit sound in a first direction and wherein a second of said speaker drivers in a second of said subsurfaces is configured to emit sound in a second direction.

12. The sound bar device of claim 11, wherein said first speaker driver is in a first plurality of speaker drivers and said second speaker driver is in a second plurality of speaker drivers.

13. The sound bar device of claim 12, wherein said first plurality of speaker drivers comprises active speaker drivers and said second plurality of speaker drivers comprises passive speaker drivers.

14. The sound bar device of claim 13, wherein said first plurality of speaker drivers are configured to emit sound toward passenger areas in a vehicle and said second plurality of speaker drivers are configured to emit sound downward toward a floor of the vehicle.

* * * * *